United States Patent [19]

Hayashi

[11] 4,441,436

[45] Apr. 10, 1984

[54] SOLID FUEL BURNING METHODS AND APPARATUS

[75] Inventor: Nobuhiko Hayashi, Shozuoka, Japan

[73] Assignee: Takumi Noma, Orangevale, Calif.

[21] Appl. No.: 437,090

[22] Filed: Oct. 27, 1982

[51] Int. Cl.[3] ..... F23B 7/00

[52] U.S. Cl. ..... 110/315; 110/316; 110/341; 110/288; 122/22

[58] Field of Search ..... 110/315, 243, 316, 244, 110/234, 248, 256, 160, 341; 122/2, 22

[56] References Cited

U.S. PATENT DOCUMENTS

| | | | |
|---|---|---|---|
| 299,578 | 6/1884 | Post et al. | 110/315 |
| 310,920 | 1/1885 | Spear et al. | 110/315 |
| 351,338 | 10/1886 | Post et al. | 110/315 |
| 391,310 | 10/1888 | Gallagher | 110/315 |
| 494,137 | 3/1893 | Gilbert | 110/315 |
| 498,258 | 5/1893 | Galbraith et al. | 110/315 |
| 992,198 | 5/1911 | Hurst | 110/315 |
| 2,237,237 | 4/1941 | Scoggin et al. | 110/288 |
| 2,656,799 | 10/1953 | Hatton | 110/288 |
| 3,585,946 | 6/1971 | Dahlund | 110/160 |
| 4,007,697 | 2/1977 | Prill | 110/288 |
| 4,296,711 | 10/1981 | Bilberg | 122/22 |
| 4,377,115 | 3/1983 | Kolz et al. | 110/234 |

*Primary Examiner*—Henry C. Yuen

*Attorney, Agent, or Firm*—Benoit Law Corporation

[57] ABSTRACT

Methods and apparatus for burning fuel from a supply of solid fuel positioned at one side of a grating light a layer of the solid fuel at the grating to discharge combustible gas. Such discharged gas is drawn through the grating to a side of the grating opposite the mentioned one side and such drawn gas is burned at the other side of the grating. Attainable temperature of said grating, acting as a primary grating, is increased by providing a secondary grating spaced from such primary grating and located between that primary grating and a fire chamber.

The methods and apparatus of the subject invention enable particulate, pelletized and other solid fuels, as well as combustible refuse and garbage, to be burned at an efficiency and convenience similar to the combustion of heating oil, and yet provide heat at a fraction of the cost of oil and gas heating methods.

15 Claims, 9 Drawing Figures

SOLID FUEL BURNING METHODS AND APPARATUS

BACKGROUND OF THE INVENTION

The subject invention relates to solid fuel burning methods and apparatus for heating, refuse or waste disposal and other purposes.

The advent and progression of the industrial age has eventuated a depletion of forests and valuable timber for fuel purposes to the extent of changing the natural character of entire regions in competition with building and paper-producing industries.

Of late, the dependency of industrial nations on fossil fuel has brought many people, industries and governments into embarrassing situations, including eonomic depression and political dependence or entanglement.

In an effort to break away from these cumbersome limitations and undesirable implications, and with the goal of restoring a healthy environment, responsible people are more and more looking at alternative energy sources.

On the home front, the wood-burning stove of past centuries is enjoying a nostalgic revival, but cannot provide a real solution on a large scale, because of inherent inefficiency and concomitant production of undesirable products of combustion.

On the other hand, householder and industrialist would be happy, under the above mentioned and prevailing circumstances, to resort to combustion of various particulate, pelletized and other solid fuels which could be provided cheaply and without substantial detriment to the environment. Similarly, a real service could be rendered to man and nature, if better thermal processes existed for disposing of combustible refuse, garbage and other waste, not only on a large scale, but readily accessible on a daily basis in millions of households.

Unfortunately, suitable equipment addressing itself to, and striking a healthy balance between, the various technological and environmental concerns in issue, has been largely lacking.

SUMMARY OF THE INVENTION

It is a general object of this invention to overcome the disadvantages and meet the needs expressed or implicit in the above background description, or in other parts hereof.

It is a related object of this invention to provide improved solid fuel burning methods and apparatus.

It is a germane object of this invention to provide improved heating methods and apparatus employing solid fuels.

It is a related object of this invention to lessen and as far as possible liberate households, farms, industries and others from a burdensome dependency on fossil fuels and other economically, environmentally and politically implicated energy sources.

It is a germane object of this invention to save forests and preserve timber for construction, paper-producing and furniture-making industries, and to lessen a diversion of valuable petroleum and coal deposits for more useful purposes, such as chemical manufacture and synthetic material production.

It is a related object of this invention to provide improved fuel burning and heating methods and apparatus characterized by a reduced if not practically eliminated production of tar, clinker and other undesirable concomitants of traditional combustion.

It is also an object of this invention to provide improved and widely accessible refuse, garbage and waste burning methods and apparatus.

It is a related object of this invention to provide improved methods and apparatus for extracting heat energy from combustible refuse, garbage, waste and other materials which would otherwise have no or only a very limited utility.

It is a germane object of this invention to convey utility to agricultural and industrial waste or heretofore largely useless by-products of processing or manufacture.

Other objects of this invention will become apparent in the further course of this disclosure.

From a first aspect thereof, the subject invention resides in a method of burning fuel from a supply of solid fuel positioned at one side of a grating. The invention according to this aspect is characterized by the improvement comprising, in combination,, the steps of providing said grating as a primary grating, increasing attainable temperature of the primary grating by providing a secondary grating spaced from the primary grating and located between the primary grating and a fire chamber, lighting a layer of the solid fuel at the primary grating to discharge combustible gas, drawing such gas through the primary and secondary gratings to the fire chamber, and buring the drawn gas.

From another aspect thereof, the subject invention resides in apparatus for burning fuel from a supply of solid fuel positioned at one side of the grating. The invention according to this aspect is characterized by the improvement comprising, in combination, a primary grating serving as said grating, means for increasing attainable temperature of the primary grating, including a secondary grating spaced from the primary grating and located between the primary grating and a fire chamber, means for lighting a layer of the solid fuel at the primary grating to discharge combustible gas, and means for drawing such gas through the primary and secondary gratings to the fire chamber for combustion in the fire chamber.

An apparatus for burning solid fuel according to a preferred embodiment of the subject invention is characterized by the improvement comprising, in combination, means including a primary grating for supporting the solid fuel against gravitational force and a vessel above such primary grating for containg the fuel, means for lighting a layer of the solid fuel on the primary grating to discharge combustible gas, a fire chamber extending from a space below the primary grating, means for increasing attainable temperature of the primary grating, including a secondary grating spaced from the primary grating and located between the primary grating and the fire chamber means spaced apart from the vessel and connected to the fire chamber for exchanging heat from the fire chamber to an outside medium, and means connected to these heat exchanging means for drawing the gas downwardly through the grating into the space below the grating for combustion in the fire chamber and emission of heat to the outside medium through the heat exchanger.

BRIEF DESCRIPTION OF THE DRAWINGS

The subject invention and its various objects and aspects will become more readily apparent from the following detailed description of preferred embodiments thereof, illustrated by way of example in the following drawings, in which.

DESCRIPTION OF PREFERRED EMBODIMENTS

Figure 1:
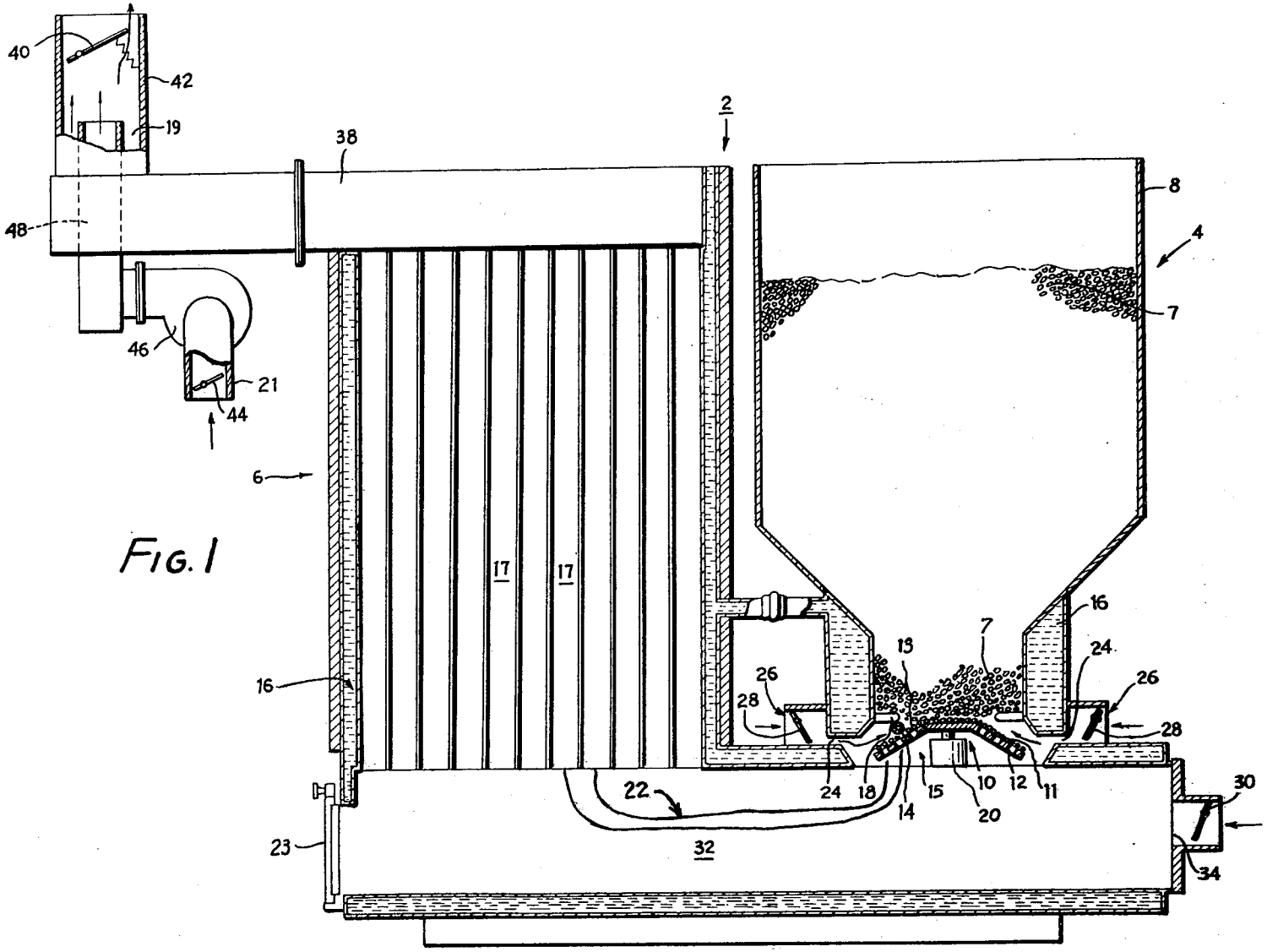
FIG. 1 is a section through apparatus for burning solid fuel and providing heat energy therefrom, according to a preferred embodiment of the subject invention.

The apparatus 2 for burning solid fuel and providing heat energy therefrom, as shown in FIG. 1 of the drawings, comprises a burner 4 and a heat exchanger 6 interconnected by a fire chamber 32 extending below the burner and the heat exchanger, according to a preferred embodiment of the subject invention.

In the embodiment shown in FIG. 1, the burner 4 and heat exchanger 6 are arranged in parallel to each other.

The burner 4 may be employed to receive and contain a supply of solid fuel or solid fuel particles 7. By way of example, particulate or pelletized fuels consisting or containing sawdust, wood shavings, wood chips, Babassu palm and other arboreal parts and products, bark, tree trimmings, agricultural waste and other solid fuels may be employed in the burners or heating apparatus according to the subject invention. Even coal, coke and firewood may be so employed. In fact, it is a special feature of the subject invention that it permits the use of inferior coal and of rather green firewood without generation of the customary effluvia, tar and clinker deposits generally associated with such uses. In addition to almond shells, walnut shells, rice hulls and other agricultural waste products, combustible refuse and garbage not only can be disposed of safely and efficiently by the burning methods and apparatus of the subject invention, but may be employed to generate heat energy at the same time.

The burner 4 has a silo 8 for containing a supply of solid fuel particles 7 above a grating 10. In the illustrated preferred embodiments, the grating supports the solid fuel against gravitational force. Within the broad scope of the subject invention, embodiments are conceivable in which the solid fuel is positioned at one side of a grating which may, for instance, extend vertically or at an angle other than as shown in any of the drawings. In either case, the solid fuel particles 7 are positioned at one side 11 of the grating 10.

The grating 10 is installed below an outlet region of the silo 8 so as to support the solid fuel particles contained in the silo against gravitational force sufficiently to impede the free flow of particles from the silo or vessel 8.

According to an embodiment of the invention, the grating may have or include a slanted portion and, to this end, may, for instance, be of a conical or pyramidal configuration.

The grating 10 has a pattern of apertures or slits for the escape of ashes into the fire chamber 32.

The method according to the subject invention includes a step of lighting a layer 13 of solid fuel particles 7 on or at the grating 10 to discharge combustible gas from the fuel. A pilot pipe or aperture 14 may be provided for lighting the solid fuel layer 13. Combustible gas or a torch may be introduced through the aperture 14 or another ignitor may be employed for lighting the fuel layer 13 on the grating 10.

As more fully disclosed below, combustible gas discharged by the lit fuel layer 13 is drawn through the grating 10 or slits 12 to a side 15 of the grating opposite the mentioned one side 11. The drawn gas from the ignited fuel particles is burned at such opposite side 15 or in the fire chamber 32.

Where the supply of solid fuel 7 is positioned on the top 11 of the grating 10 as shown in the drawings, the gas discharged by ignited fuel particles is drawn downwardly through the grating and is burned below such grating. This, according to the subject invention, is thus just the opposite of conventional furnaces, where the burning of gas discharged from ignited fuel takes place on the same side of the grating on which the ignited fuel is located. This principle of the subject invention also applies if the grating extends vertically or at any angle to the force of gravity. In that case, the solid fuel is also positioned at one side of the grating and gas discharged from ignited fuel at that one side of the grating is drawn through the grating to the opposite side thereof for burning at that opposite side of the grating.

Even though the grating 10 supports the fuel particles 7 against gravitational force, some of the lowermost particles can roll or creep along the slanted top surface 11 of the frustoconical or pyramidal grating structure. The particles are this distributed in an ignited layer over the top surface of the grating and are burned to ashes by the time they reach the grating circumference. It is a special feature of the illustrated preferred embodiment of the subject invention, that combustible gases are expelled from fuel particles at the grating 10 by the most efficient process of dry distillation.

In practice, this permits achievement of the highest temperature, inhibiting a formation of tar and noxious effluvia for all practical purposes. Also, the combustion is most complete in this manner and does not result in the formation of clinker or other formations which would obstruct the grating apertures 12. Rather, the fuel particles are completely burned and any fine ashes formed thereby are easily removed from the fire chamber 32 below the grating.

Burner 4 and heat exchanger 16 are provided with water jackets 16. Since combustible gas discharged by ignited fuel particles is drawn into and burned in the fire chamber 32, the water jacket for the burner 4 may be minimal, covering only the fuel outlet region at the grating.

The fire chamber 32 is connected by pipes or passages 17 in the heat exchanger 6 to an exhaust duct 38. In the illustrated embodiment, the passages 17 rise through the heat exchanger from the fire chamber 32 at the bottom thereof to the exhaust duct 38 at the heat exchanger top. The duct 38, in turn, issues into a chimney or flue 42 for an emission of flue gas and similar non-combustibles.

In practice, combustible gas discharged from fuel particles preferably by dry distillation at the upper side 11 of the grating 10 is drawn through such grating by providing at the opposite side 15 of the grating a pressure lower than a pressure at the one side 11 of the grating. In other words, what may be called an "underpressure" is provided at the lower side 15 of the grating relative to the upper side 11 thereof.

In this respect, the illustrated preferred embodiments of the subject invention provide a flue 42 and a passage including the fire chamber 32, the heat exchanger pipes 17 and the exhaust duct 38, extending from the opposite side 15 of the grating 10 to the flue 42. As an important feature of the subject invention, the lower side 15, from which the combustible gas passage extends, is at the side of the grating opposite the top side 11 on which the fuel supply is deposited by means of the silo 8. This is thus just the opposite from conventional furnaces in which combustible gas rises through the fuel supply.

However, contrary to conventional practice, the subject invention draws the combustible gas through the grating 10 on which the fuel 7 is located, and further through the passage 32, 17 and 38 to the flue 42.

In many practical applications, the flue 42 or a chimney connected thereto will provide a natural draft for the proper functioning of the illustrated embodiments. On the other hand, natural convection may be aided by injecting into the flue 42 an additional gas having a temperature lower than an inside temperature of the flue. For instance, a secondary pipe 48 of a diameter smaller than the diameter of the flue, may be inserted into the flue so as to extend from the outside of the flue into and partially through the flue, in order to conduct outside air into the flue. In this manner, the temperature difference between the inside of the flue and the outside air will improve convection currents in the flue, thereby increasing the draft with which combustible gas is drawn through the grating 10 to the lower side 15 thereof and through the fire chamber 32.

According to the illustrated embodiments, the auxiliary pipe 48 has a smaller diameter than the flue 42 and extends into such flue upwardly, leaving a hollow-cylindrical space 19 for the exhaust of flue gas from the heat exchanger.

In situations where the provision of an auxiliary pipe is not of itself sufficient to establish the desired draft, a blower 46 may be provided for injecting outside air or another suitable gas via the pipe 48 into the flue 42. A damper 44 may be provided in an intake 21 of the blower 46 in order to provide for a regulation of the draft in the fire chamber 32 and flue 42. In cases where the blower 46 is not necessary, the damper 44 may be provided in or at the secondary pipe 48.

According to the subject invention, combustible gas drawn from the fuel particles is burned in the passage to the flue on the side of the grating opposite the side on which the fuel particles are located. In the illustrated preferred embodiments, drawn combustible gas, symbolically illustrated at 22, is burned in the space below, or at the opposite side 15, of the grating 10 and in the region of the fire chamber 13 adjacent thereto. In practice, a special ignitor in the fire chamber is unnecessary for this purpose, as the combustible gas is lit from the layer 13 of ignited fuel particles or by the grating 10 heated thereby.

The burning of combustible gas is preferably completed in the fire chamber 32 whereby only non-combustible gases will rise through the heat exchanger 6, thereby heating the water in the jacket 16 for use of the heat energy thus provided in any desired manner.

To sustain combustion, oxygen or air is drawn through primary supply passage 26 to the grating region and through a secondary passage 34 to the fire chamber area. Automatically operating or adjustable dampers 28 and 30 may be provided in these passages for a regulation of the combustion process in the fire chamber 32 extending from the bottom of the grating 10 to the bottom of the heat exchanger 6.

The flue 42 may be equipped with an automatic or adjustable exhaust valve 40, without disturbing the establishment and maintenance of the requisite negative presssure at the lower or opposite side 15 of the grating 10.

By the supply of primary air via passage 26, solid fuel 7 is gasified at the first side 11 of the grating and the resulting combustible gas if drawn according to the subject invention through the grating to the opposite side 15 thereof, in order to ignite in the fire chamber 32 upon mixture with secondary air or oxygen drawn through the passage 34.

The solid fuel 7 burns out and forms into ashes which pass through slits 12 to the other side 15 of the grating. In the illustrated preferred embodiments, the ashes thus fall into the fire chamber 32 and are easily removed therefrom upon opening of a fire chamber door 23, preferably during intervals when the burner is not in use. If desired, an Archimedes screw or other automatic conveyor (not shown) may be employed for removing ashes from the fire chamber. Similarly, an automatic conveyor (not shown) may be employed for continually supplying solid fuel particles to the silo 8.

In most cases, satisfactory operation will be obtained with a stationary grating. In some situations and with some fuels, continual movement of the grating according to an embodiment of the subject invention is, however, more advantageous. By way of example, the embodiment shown in FIG. 1 uses a vibrator or motor 20 in order to move the grating 10 relative to stationary stirring bars 18 which prevent the movement of the grating to be imparted to the fuel supply as a whole. By way of example, the motor 20 may include a worm gear (not shown) driven from the outside of the burner or an electric vibrator, all of which may be of conventional design. The grating 10 may thus rotate slowly, shake or vibrate, whatever is best for the particular fuel.

The goal in this respect is to distribute ignited fuel particles in a layer over the effective area 11 of the grating, whereby the grating is uniformly heated to induce dry distillation and complete gasification of fuel particles 7. Throats 24 of restricted cross-section in the primary air passages 26 promote such dry-distillation effect.

Figure 2:
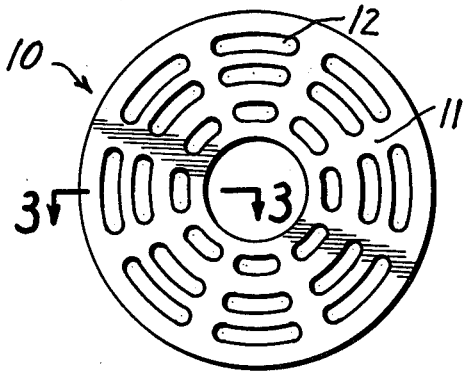
FIG. 2 is a top view of a grating employed in a burner section of the apparatus shown in FIG. 1.

As seen in the top view of the grating shown in FIG. 2, an arrangement of concentric grating slits or aperture segments 12 is presently preferred. As shown in the partial cross-section of FIG. 3, the slits 12, according to one illustrated embodiment, extend at a predetermined angle 25 to a horizontal plane through the sloped grating section.

Figure 3:
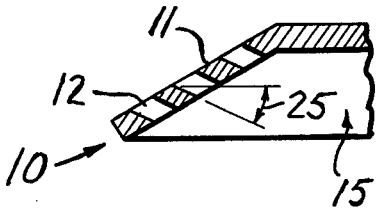
FIG. 3 is a partial showing, on an enlarged scale, of a section taken on the line 3—3 in FIG. 2.

In the embodiment illustrated in FIG. 3, the sum of the angle 25 and of the slope of the conical portion of the grating at 11, relative to the horizontal plane, is less than 90 degress.

The grating according to the cross-section of FIG. 3 is particularly well suited for fuel material with high volatility, including brown coal briquet, lignite and sub-bituminous coal.

Figure 4:
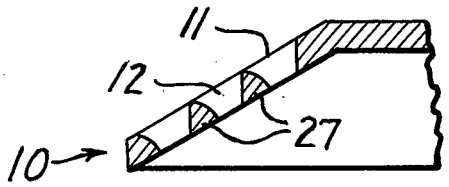
FIG. 4 is a view similar to FIG. 3, illustrating a modification of the grating structure.

According to the further embodiment shown in FIG. 4, the bars or portions 27 of the grating 10 between the slits 12 are rounded at the slits 12 where they face the upper grating side 11. In this manner, fuel pellets or other fuel particles of a similar configuration can move into the hot grating for gasification therein, but are securely retained thereat until complete gasification, whereby the resulting ashes fall easily through the slots 12. In general terms, the grating according to FIG. 4 represents an example of a grating structure having tapered slits 12 therethrough.

Figure 5:
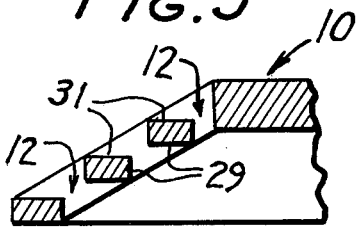
FIG. 5 is a view similar to FIG. 3, illustrating a further modification of the grating structure.

The grating structure shown in the partial cross-section of FIG. 5 is particularly useful for fuel materials with low volatility, such as sawdust and Babassu palm cuttings.

According to FIG. 5, the bars or portions 29 of the grating between the slits 12 provide platforms 31 on which fuel particles can rest pending gasification, in order to fall through the slits as ash upon completed exhaustion of combustible gases therefrom.

Figure 6:
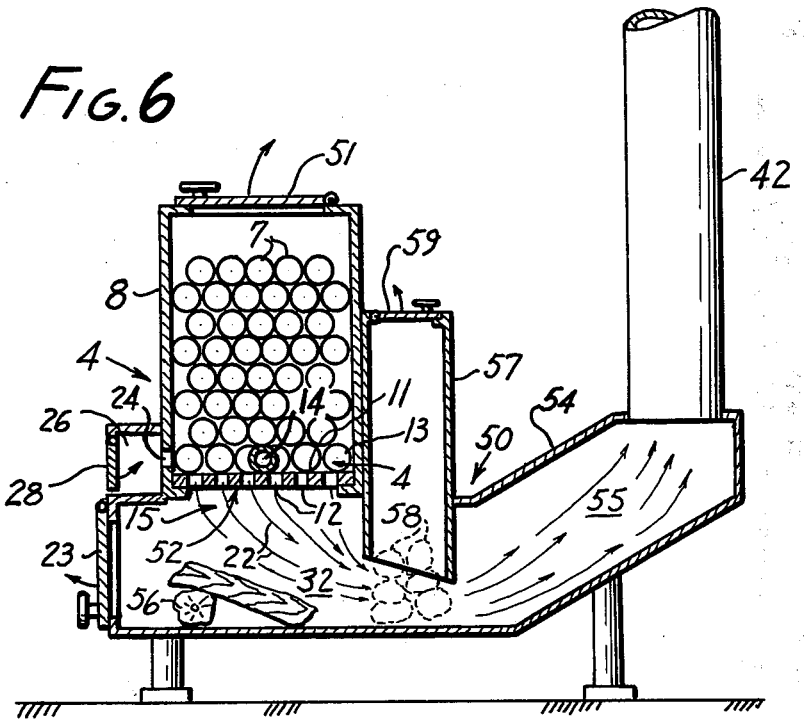
FIG. 6 is a section through a furnace or stove for burning solid fuel and optionally waste according to a further embodiment of the subject invention.
Figure 7:
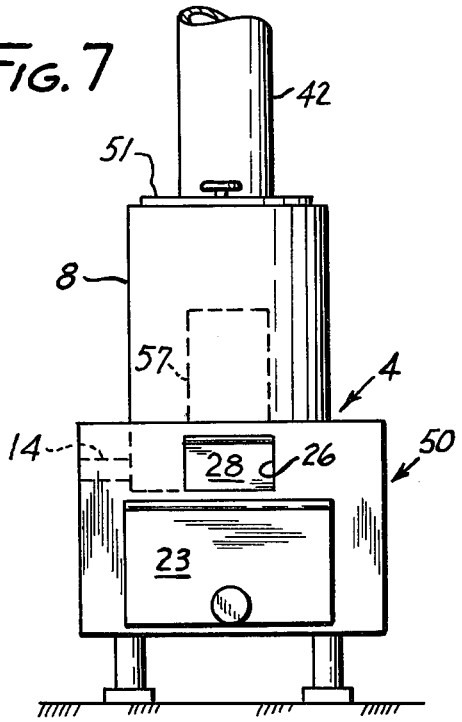
FIG. 7 is a front elevation of the furnace or stove shown in FIG. 5.

The furnace or stove 50 shown in FIGS. 6 and 7 is similar in principle and practically identical in many respects to the burner, fire chamber and exhaust portions of the apparatus shown in FIG. 1. The same also applies to a common detail of FIGS. 1 and 8. Accordingly, like reference numerals have been employed for like or functionally equivalent parts as among FIGS. 1 and 6 to 8, and reference should be had to the above description of FIG. 1, for a further description of such like or functionally equivalent components beyond what will presently be described relative thereto.

Figure 8:
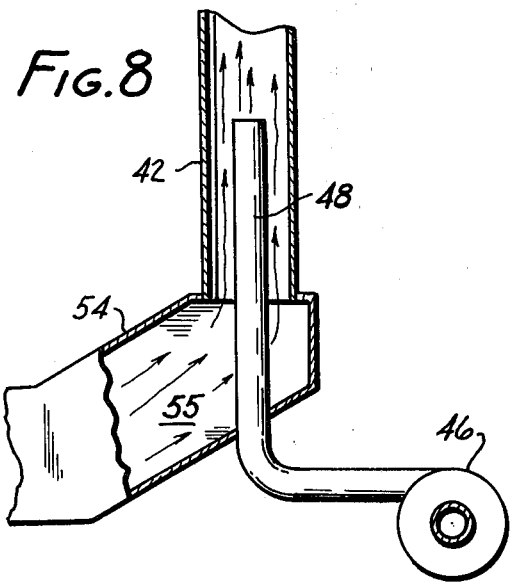
FIG. 8 is a view similar to part of FIG. 6, showing a modification according to a further embodiment.

At present, the apparatus of FIG. 1 has been implemented in practice for industrial use, while the stove 50 according to FIGS. 6 to 8 has been destined for home use and agricultural applications, such as green houses and the like. However, no such dichotomy is intended as far as the utility of the subject invention and its embodiments is concerned.

Like the apparatus of FIG. 1, the stove of FIGS. 6 and 7 has a silo 8 for the containment of solid fuel particles 7 at a burner 4. On top of the silo 8, the stove 5 has a lid 51, so that the silo region may be closed throughout the intervals between replenishment of fuel in the silo. A similar lid, may, of course, also be provided on top of the silo 8 in the apparatus of FIG. 1. It should, however, be understood in this respect that the operation of both the apparatus 2 shown in FIG. 1 and the stove 50 shown in FIG. 6 is characterized by the drawing of the combustible gas through the grating structure away from the silo and solid fuel particles.

This, in practice, prevents the burning process from backfiring into the silo 8 or from otherwise exposing stored fuel above the ignited bottom layer 13 to premature ignition.

In the stove 50, a horizontal grating 52 has been shown. Indeed, such a flat grating may also be employed in the burner 4 of FIG. 1, and may thus provide the desired grating apertures or slits 12. On the other hand, any of the grating embodiments shown in FIGS. 1 to 5 may also be employed in the stove 50 of FIGS. 6 to 8. The goal and accomplishment in either case is an ideally complete gasification of the solid fuel particles, without formation of tar and clinker and other contaminants which, for instance, could impede the removal of ash through the grating slits 12.

The stove according to FIGS. 6 to 8 is again operated by lighting a layer 13 of solid fuel particles 7 on or at the grating 52 to discharge combustible gas from the fuel. As in the case of FIG. 1, a pilot tube or aperture 14 may be provided for lighting the solid fuel layer with the aid of a combustible gas or torch or another ignitor.

As before, combustible gas discharged by the lit fuel layer 13 is drawn in the same direction as the ash descending from such particles, namely from the first side 11 of the grating, through grating slits 12 to the side 15 opposite the grating 52. Oxygen or air is supplied to the combustion via passages 24 and 26 and a butterfly valve 28, which may, for instance, be of an automatic type, swinging freely in a corresponding aperture of the stove housing. If desired, the butterfly valve 28 could be positioned in the side of the silo 8 above the fuel particles 7. The passage 24 may then be closed.

Again, the fire chamber 32 is located at the opposite side 15 of or below the grating 52 and gases drawn from the fuel particles are burned in such fire chamber. If desired, a controllable secondary air passage similar to the passage 34 shown in FIG. 1 may also be employed in the stove 50, such as at the door 23 or other boundary of the fire chamber.

If desired, the stove 50 may also be equipped with a heat exchanger structure having a water jacket 16 and/or internal passages 17. However, the embodiment of FIGS. 6 to 8 has a simplified heat exchanger portion including parts of the housing 54 through which heat is radiated from a passage 55 of the fire chamber extending beyond the opposite side 15 of the grating to the flue 42.

As in the embodiment of FIG. 1, the flue 42 in FIGS. 6 to 8 is spaced from and elevated with respect to the grating 52. In addition, the embodiment shown in FIGS. 6 to 8 provides the space 55 as an upperwardly slanted passage from the opposite side 15 of the grating to the flue 42. This, in practice, enhances the creation of the desired negative or underpressure at the second side 15 of the grating, relative to the fuel silo 8 and first side 11.

Accordingly, combustible gas discharged by fuel particles at the grating 52 is vigorously drawn through such grating to the second side 15 thereof, for burning in the fire chamber 32 and extended passage 55 to the flue 42.

As shown in the detail view of FIG. 8, the stove 50 of FIGS. 6 and 7 may be equipped with a secondary pipe 48 in order to augment the draft of combustible gases through the grating 52 into the fire chamber and extended passage 55. As in the embodiment of FIG. 1, a blower 46 may additionally be employed for that purpose. There thus may be injected into the flue 42 an additional gas, such as air, having a temperature lower than the inside temperature of the flue.

According to an embodiment of the invention illustrated in FIG. 6, combustible materials may be fed to the fire chamber 32 or to the drawn burning gas for combustion at the opposite side of the grating 15. In other words, whilst fuel particles 7 are fed to a first side 11 of the grating 52, other fuel or combustible material, such as firewood logs 56, may be fed to the fire chamber 32 for combustion at the opposite side 15 of the grating 52. For safety reasons, it is preferable that the silo lid 51 be closed when the fire chamber door 23 is opened for the insertion of firewood 56 or other combustibles into the fire chamber 32.

According to a related embodiment of the subject invention, the stove 50 has a secondary silo or compartment 57 for the reception of combustible refuse garbage or waste 58. The secondary compartment 57 has a lid 59 which may be opened for an addition of waste 58. Even when such waste is moist, it is safely and thoroughly burned in the fire chamber, like the firewood 56, by the high heat of the flames existing therein.

Refuse which up to now had to be picked up from the home may thus safely and conveniently be disposed of, and generate heat energy at the same time.

Figure 9:
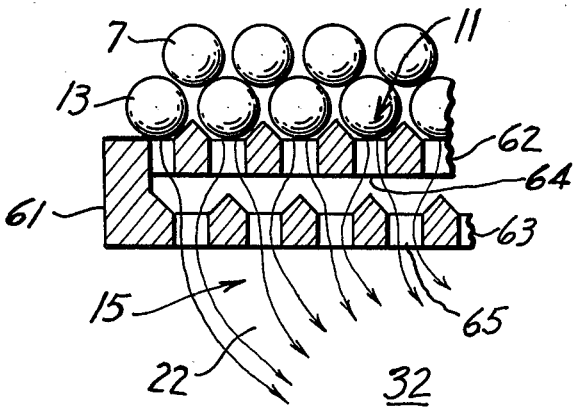
FIG. 9 is a section through part of a dual grating according to an embodiment of the subject invention, for use in the apparatus of FIGS. 1 and 6 to 8.

FIG. 9 shows an improved grating structure 61 according to a further aspect of the subject invention which may be employed in either or both of the apparatus of FIGS. 1 and 6 to 8.

According to FIG. 9, the grating structure 61 is composed of distinct grating elements 62 and 63, and such grating elements are spaced from each other between the above mentioned one grating side 11 and opposite other grating side 15. Similarly, the above mentioned grating passages or slits 12 are jointly provided by passages 64 and 65 in the grating elements 62 and 63, respectively.

In the case of FIG. 9 and in all other cases herein illustrated, it is important to know, as a significant feature of the subject invention, that the ash resulting from the gasification process is caused to penetrate the grating in the same direction as the gas discharged by the fuel particles. In other words, when the dual grating 61 is employed in the burner 4 in FIG. 1 or the stove 50 in FIG. 6, gas discharged by the lit layer 13 of fuel particles 7 is drawn through the grating structure in the same direction as the ashes resulting from the gasification or dry distillation of fuel particles.

Accordingly, combustible gases 22 are drawn through grating apertures 64 and 65 in series for ignition in a fire chamber at the lower or second side 15 of the grating.

The dual grating 61 shown in FIG. 9 may be considered as composed of a top or primary grating 62 and a lower or secondary grating 63. The secondary grating 63 is located between the primary grating 62 and the fire chamber 32, thereby enabling the primary grating to attain a higher temperature, than if the secondary grating were not present. This, in turn, enhances the dry-distillation effect imposed on the layer 13 of solid fuel particles on the primary grating.

Accordingly, the fuel particles are gasified to the maximum possible extent, producing an optimum of combustible gases for heat generation in and at the fire chamber, and leaving only thin ashes which easily penetrate the apertured grating structure for convenient removal from the fire chamber, without clogging the grating by a clinker formation. The flame temperature in the fire chamber is thus very high, whereby any carbage or other refuse 58 is thoroughly burned without noxious tar formations or smoke forming in or leaving the furnace.

In this and every other respect, the subject invention thus meets all of its objects.

The subject extensive disclosure suggests and renders apparent to those skilled in the art various modifications and variations within the spirit and scope of the invention and equivalents thereof.

I claim:

1. In a method of burning fuel from a supply of solid fuel positioned at one side of a grating, the improvement comprising in combination the steps of:

providing said grating as a primary grating;

increasing attainable temperature of said primary grating by providing a secondary grating spaced from said primary grating and located between said primary grating and a fire chamber;

lighting a layer of said solid fuel at said primary grating to discharge combustible gas;

drawing said gas downwardly through said primary and secondary gratings to said fire chamber; and burning said drawn gas in said fire chamber.

2. A method as claimed in claim 1, wherein:

said supply of solid fuel is positioned on top of said primary grating.

3. A method as claimed in claim 1, wherein:

said gas is drawn through said primary and secondary gratings by providing in said fire chamber a pressure lower than a pressure at said one side of the primary grating.

4. a method as claimed in claim 1, including the steps of:

providing a flue;

providing a passage from said fire chamber to said flue;

drawing said gas through said grating and through said passage toward said flue; and burning said gas in said passage to said flue.

5. A method as claimed in claim 4, including the step of:

injecting into said flue an additional gas having a temperature lower than an inside temperature of said flue.

6. A method as claimed in claim 1, wherein:

said solid fuel in said layer is subjected to dry distillation for emitting said gas.

7. A method as claimed in claim 1, iuncluding the steps of:

feeding combustible materials to said drawn burning gas for combustion in said fire chamber.

8. In apparatus for burning fuel from a supply of solid fuel positioned at one side of a grating, the improvement comprising in combination:

a primary grating serving as said grating;

means for increasing attainable temperature of said primary grating, including a secondary grating spaced from said primary grating and located between said primary grating and a fire chamber;

means for lighting a layer of said solid fuel at said primary grating to discharge combustible gas; and means for drawing said gas downwardly through said primary and secondary gratings to said fire chamber for combustion in said fire chamber.

9. Apparatus as claimed in claim 8, including:

means for positioning said supply of solid fuel on top of said primary grating.

10. Apparatus as claimed in claim 8, wherein:

said drawing means including means for providing in said fire chamber a pressure lower than a pressure at said one side of the grating.

11. Apparatus as claimed in claim 8, including:

a flue; and a passage extending from said fire chamber to said flue;

said drawing means including means for drawing said gas through said primary and secondary gratings and through said passage toward said flue for combustion in said passage to said flue.

12. Apparatus as claimed in claim 11, including:

means for injecting into said flue an additional gas having a temperature lower than an inside temperature of said flue.

13. Apparatus as claimed in claim 8, including:

means for continually moving said grating.

14. Apparatus as claimed in claim 8, including:

means for feeding combustible materials to said fire chamber for combustion with said drawn gas.

15. In apparatus for burning solid fuel, the improvement comprising in combination:

means including a primary grating for supporting said solid fuel against gravitational force and a vessel above said primary grating for containing said fuel;

means for lighting a layer of said solid fuel on said primary grating to discharge combustible gas;

a fire chamber extending from a space below said primary grating;

means for increasing attainable temperature of said primary grating, including a secondary grating spaced from said primary grating and located between said primary grating and said fire chamber;

means spaced apart from said vessel and connected to said fire chamber for exchanging heat from said fire chamber to an outside medium, and means connected to said heat exchanging means for drawing said gas downwardly through said grating into said space below said grating for combustion in said fire chamber and emission of heat to said outside medium through said heat exchanger.

* * * * *